United States Patent [19]

Gulliksen

[11] 4,373,178

[45] Feb. 8, 1983

[54] METHODS AND APPARATUS FOR CONTROLLING REFLECTED LIGHT

[75] Inventor: John E. Gulliksen, Shrewsbury, Mass.

[73] Assignee: Koehler Manufacturing Company, Marlborough, Mass.

[21] Appl. No.: 203,273

[22] Filed: Nov. 3, 1980

[51] Int. Cl.[3] ..... F21V 7/00

[52] U.S. Cl. ..... 362/280; 362/308; 362/309; 362/329; 362/335

[58] Field of Search ..... 362/280, 308, 309, 329, 362/335

[56] References Cited

U.S. PATENT DOCUMENTS 1,874,086 8/1932 Dickson ..... 362/335

*Primary Examiner*—Stephen J. Lechert, Jr.

*Attorney, Agent, or Firm*—Hamilton, Brook, Smith and Reynolds

[57] ABSTRACT

Luminaire apparatus, including a luminaire having a paraboloidal reflecting surface and a source of radiant energy such as a light source located at the focal point of the reflecting surface, is combined with means for selectively refracting light emitted by the light source and carrying out an improved method of producing a flood configuration of reflected light.

19 Claims, 27 Drawing Figures

METHODS AND APPARATUS FOR CONTROLLING REFLECTED LIGHT

The improved method of the invention is characterized by transmission of light rays through optically shaped transparent refracting means which provide for clear refraction and the creation of a multiplicity of apparent light sources. The light sources, when viewed at points externally of the luminaire apparatus, consist of "point" sources of light lying in a locus of such point sources in spaced relation to the focal point of the reflecting surface. An apparent emission of light is produced at each of these apparent light sources or points; such emitted light impinges upon the reflecting surface in the luminaire body and is reflected from the reflecting surface in multiple paths of travel, the majority of which are not parallel to the central axis of the reflecting surface.

Recognition of the phenomenon that a multiplicity of light sources may be created makes possible, for the first time in the art, a practical method of producing a flood distribution of projected light wherein the breadth, extent, uniformity, etc. of the flood distribution may be predetermined and controlled by the selection of an appropriate locus for the apparent light sources. The selected locus may be, for example, one or more annular rings located around the central axis of the luminaire body, one or more lines parallel to the central axis of the luminaire body, an array of spaced apart discrete points, or other configurations.

The invention method provides, in all desirable embodiments, for creating apparent light sources by utilizing a transparent tubular body which is substantially free from any translucency characteristics. The tubular body is optically constructed with refracting lens portions having focal points lying in a predetermined locus of such points. In the invention method the transparent tubular body is arranged to surround the light source of the luminaire body so that this tubular body may be interposed between the reflecting surface and the light source of the luminaire body. Movement of the tubular body in a direction parallel to the central axis of the reflecting surface provides for adjusting the distribution of projected light between a spot configuration and a flood configuration. In one preferred embodiment the tubular body further includes complementary reflector means.

BACKGROUND OF THE INVENTION

It is well known in the luminaire art to combine a paraboloidal reflecting surface with a light source located at the focal point of the said reflecting surface to project light rays in parallel paths of travel, thus producing a spot configuration of reflected light. It is also known that a sleeve member of translucent or frosted material will, when interposed between the light source and the reflecting surface, provide a flood configuration of reflected light due to the scattering of the light rays as they pass through the material of the sleeve member. U.S. Pat. No. 1,991,753 (Kurlander) illustrates such a device wherein the inventor specifies that a translucent material must be used. In this invention a sleeve member is moveable in a direction parallel to the central axis of a reflector to provide an adjustment of distribution between spot and flood. In addition, a translucent or frosted sleeve member having angular serrations on an outer surface is disclosed.

A translucent or frosted sleeve arrangement such as that described in the above referenced patent, however, presents certain disadvantages. Firstly, the use of a translucent or frosted material for the sleeve member of such an arrangement is quite costly in terms of luminaire efficiency; such materials diffuse light by a principle known as "scattering". In the case of a translucent material the scattering effect is caused by the presence of tiny opaque or reflective particles suspended in the medium of the material. A light ray entering such a material is redirected by reflection each time it encounters such a particle; rays emerging from the material, therefore, have been reflected from and redirected by many such particles, and a portion of the light energy of each ray has been absorbed by each such encounter. In addition, some rays will be redirected backward (toward the light source), a phenomenon known as "backscattering", and thus will not emerge in the direction of the reflecting surface. Further, the complex path of travel produced by a myriad of such encounters will cause some rays to be permanently lost within the material; that is, the number of encounters may be sufficiently great as to absorb virtually all of the light energy of these rays. A prime example of a translucent material is fog; clearly this is a translucent material in which the phenomena of scattering, backscattering (experienced as glare) and absorption may be seen.

Frosted materials exhibit similar effects, albeit for slightly different cause. In this case at least one surface of a nominally transparent material is treated such that these surfaces become etched or microscopically pitted. These pits are partially opaque or reflective and act in much the same way as the aforementioned particles; light is redirected by scattering, it may be backscattered and it may be absorbed.

Clearly, scattering will cause light to emerge from such a material in a totally random fashion. In fact, observation of a standard frosted light bulb will indicate that the entire surface of such a material becomes a "secondary emitter" of light; that is, the entire surface appears to be luminous. Control of distribution of such light with a paraboloidal reflecting surface is nearly impossible because of the random angles of incidence of light upon the reflecting surface. This is definitely a second disadvantage.

The addition of angular serrations to one or more surfaces of a translucent or frosted sleeve member has no effect other than to increase the degree of scattering. Indeed, such serrations may further lower the transmissive efficiency of the sleeve member since backscatter and absorptive effects may be increased.

A third disadvantage of the above referenced invention is the requirement for a relatively large hole in the reflector surface concentric with the central axis in order to permit travel of the sleeve member (to allow adjustment between spot and flood). This requirement reduces luminaire efficiency, particularly in spot adjustment, due to the loss of light through this hole.

SUMMARY OF THE INVENTION

This invention relates to the luminaire art, and to an improved method and apparatus for producing a predetermined and controlled flood effect from a luminaire which includes a paraboloidal reflecting surface and a light source located at the focal point of the said reflecting surface.

It is a chief object of the invention to devise a method for producing a predetermined and controlled flood effect from such a luminaire, wherein light distribution may be tailored to a given illumination requirement.

It is a second object of the invention to devise a tubular lens member, interposable between a light source and a reflecting surface, which will redirect light by clear refraction and thus overcome the adverse effects of translucent or frosted materials.

It is another object of the invention to devise complementary reflector means affixed to a tubular lens member to increase efficiency of a luminaire body having a moveable lens member of this type.

The invention method accomplishes the first two objects by providing multiple apparent light sources lying in a predetermined locus of such sources, the apparent light sources providing light rays which impinge on a paraboloidal reflecting surface at angles of incidence such that, when reflected, these rays will produce the desired flood configuration. Means to apply the method comprises a tubular lens member including refracting lens portions.

The third object is realized by the addition of a reflecting portion to at least one end of the tubular lens member such that, when the tubular lens member is withdrawn into a non-operative position, the reflecting portion substantially closes the hole through which the tubular lens member is travelled.

DETAILED DESCRIPTION OF THE INVENTION

It is characteristic of a convex lens which has at least one surface corresponding to a portion of the surface of a sphere that such a lens possesses a focal point. If a point light source is located at such a focal point, rays of light entering the lens are refracted according to Snell's Law and are emitted therefrom in paths of travel which are parallel to one another and which are also parallel to the central axis of the lens. Should the point source be moved toward the lens, the emergent rays will diverge from one another; should it be moved further from the lens, the rays will tend to converge. Conversely, if a beam of light comprising parallel rays is directed back at the lens in paths of travel parallel to the central axis, refraction will cause the emergent rays to converge at the focal point.

In addition, should a light beam comprising parallel rays be directed backward at the lens in paths of travel not parallel to the central axis, the emergent rays will still converge, but not at the focal point.

From the combined effects noted above it can be seen that, for any given convex lens having a spherical surface, there will be a definable point at which a light source could be located to produce a desired divergence of emergent rays, as well as a desired amount of skewness of these rays to the central axis.

The same is somewhat true with a paraboloidal reflecting surface. Such a surface has a focal point, that is, a point at which a light source could be located in order to produce emergent or reflected rays in paths of travel that are parallel to one another and to the central axis. Moving the light source may cause divergence, convergence and/or skewness.

Further, it has been found that a lens body need not have a surface that is truly a portion of a sphere in order to exhibit focusing effects of a sort, provided that in at least one cross-sectional view a surface is illustrated as being an arc of a circle. For example, if a round rod has removed therefrom a section parallel to its longitudinal central axis a radial cross-section presents a surface which is represented by an arc of a circle, and this arcuate portion has its "focal point". This "focal point" is actually not a single point, but comprises a series of points whose locus forms a line parallel to the central longitudinal axis of the original rod and passing through the actual focal points of all individual cross-sectional "slices" of the remaining part of the rod.

Figure 1:
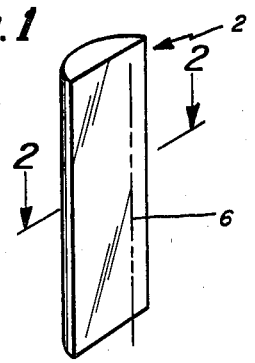
FIG. 1 is a perspective view of a plano-convex cylindrical lens element, showing a linear locus of apparent light sources.
Figure 2:
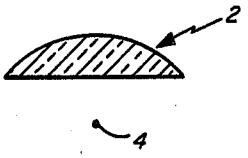
FIG. 2 is a cross-section taken on the line 2—2 of FIG. 1.

In FIG. 1 there has been illustrated a lens body of the character described, denoted by arrow 2. A cross-section of the lens body 2 is shown in FIG. 2. The focal point of an infinitely thin "slice" of the lens body 2 is denoted by numeral 4, and the locus of all such focal points is indicated by numeral 6 in FIG. 1.

Figure 3:
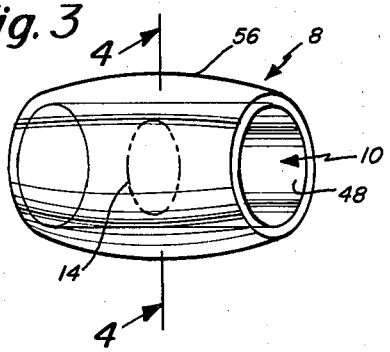
FIG. 3 is a perspective view of one form of tubular lens member of the invention, showing an annular locus of apparent light sources.

Another form of lens body which illustrates the desired characteristics is denoted by arrow 8 in FIG. 3. Here a substantially ovoid body has been truncated by two spaced apart parallel planes and then "cored out" to provide a cylindrical opening denoted by arrow 10.

Figure 4:
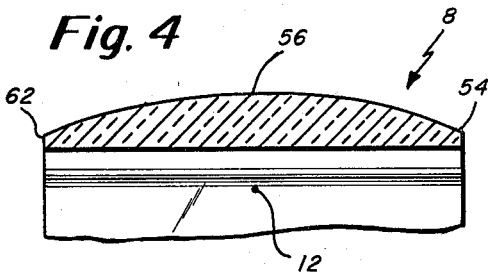
FIG. 4 is a cross-section taken on the line 4—4 of FIG. 3.

A cross-sectional infinitely thin "slice" of body 8 is shown in FIG. 4 with its focal point being denoted by numeral 12. This focal point, when translated back by rotation of the "slice" into the three-dimensional body shown in FIG. 3, will comprise an array of points having a locus which is an annular ring, denoted by arrow 14 in FIG. 3.

Although the method of the invention may be applied as well to a variety of other configurations which will be enumerated and discussed later, an embodiment similar to that of FIGS. 3 and 4 will be utilized in the initial explanation of the method for the sake of clarity.

Figure 5:
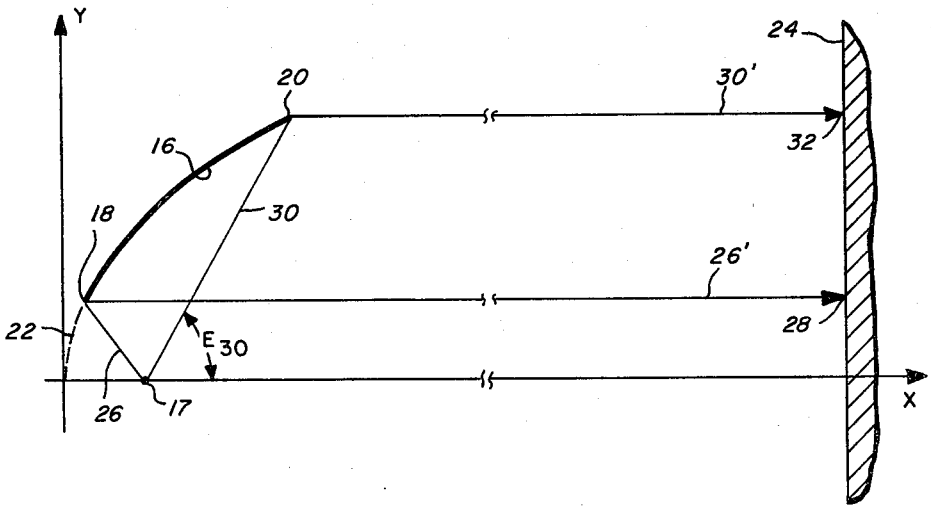
FIGS. 5–9 are diagrammatic views illustrating the method of providing apparent light sources as disclosed in the text of the specification.

FIG. 5 illustrates diagrammatically a paraboloidal reflecting surface 16 having a focal point 17 which will, for purposes of this disclosure, be considered as coincident with a point source of light. A hole occurs in the center of the reflecting surface 16, and thus the surface 16 is shown as a curved line extending from a point 18 to another point 20. The location of point 18 may be described in terms of Cartesian coordinates as $x_{18}$, $y_{18}$, that of point 20 as $x_{20}$, $y_{20}$, etc. Locations of other points are defined in a similar manner. It is assumed that the origin of the reflecting surface (as extended by curved dashed line 22) is at the point defined by the coordinates $x=0$, $y=0$.

Located at some distance measured from the origin ($x=0$, $y=0$), which distance may be referred to as $x_{24}$, is a "target surface" 24 as shown in FIG. 5. Light ray 26, emitted from point source 17, impinges on reflecting surface 16 at point 18 and is reflected outward as ray 26', parallel to the x-axis of FIG. 5 (i.e. the central axis of the reflecting surface) to impinge upon target surface 24 at a point which may be defined by coordinates $x_{24}$, $y_{18}$, which point is denoted by numeral 28.

Figure 6:
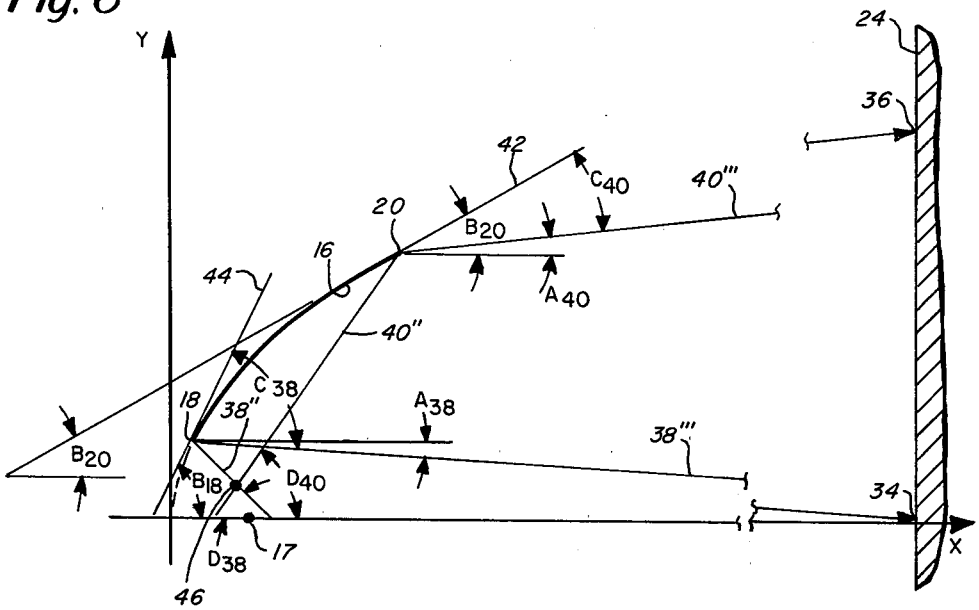

Similarly, light ray 30 impinges upon reflecting surface 16 at point 20 and is reflected outwardly as ray 30', striking target surface 24 at a point which may be defined by coordinates $x_{24}$, $y_{20}$, which point is denoted by numeral 32. In accordance with the invention, it may be desired to modify the distribution of light such that the area illuminated on target surface 24 will extend from a point 34 to a point 36 as shown in FIG. 6. The light ray striking point 34 will have been reflected from point 18, the light ray striking point 36 will have been reflected from point 20. These rays are designated 38''' and 40''' respectively.

Attention is first directed to ray 40'''. This ray makes an angle $A_{40}$ with a line parallel to the x-axis such that $$\tan A_{40}=(y_{36}-y_{20})/(x_{24}-x_{20}). \quad (1)$$

A line 42, tangent to reflecting surface 16 at point 20, is now derived. Since the standard equation for a parabola is $$y^2=4ax, \quad (2)$$

the angle which a tangent line will make with respect to the x-axis may be obtained by differentiation:

$$dy/dx=2a/y \quad (3)$$

For point 20, shown in FIG. 6, this derived angle, $B_{20}$, is such that $$\tan B_{20}=2a/y_{20} \quad (4)$$

The angle of reflection, with respect to the tangent line 42, of ray 40''' is expressed by $$C_{40}=B_{20}-A_{40}. \quad (5)$$

Since the angle of incidence must equal the angle of reflection the incident ray 40'', which impinges upon point 20, may be derived. The angle which this ray 40'' makes with respect to the x-axis is expressed by $$D_{40}=B_{20}+C_{40}=2B_{20}-A_{40}. \quad (6)$$

Now, with respect to ray 38''':

$$\tan A_{38}=(y_{34}-y_{18})/(x_{24}-x_{18}) \quad (7)$$

The line tangent to point 18, denoted by 44, will occur such that:

$$\tan B_{18}=2a/y_{18} \quad (8)$$

$$C_{38}=B_{18}-A_{38} \quad (9)$$

$$D_{38}=B_{18}+C_{38}=2B_{18}-A_{38}. \quad (10)$$

The standard line equation $$y=mx+b \quad (11)$$

may be employed for both rays 38'' and 40'' to find their y-intercepts $b_{38}$, $b_{40}$:

$$b_{38}=y_{18}-(x_{18}\tan D_{38}) \quad (12)$$

$$b_{40}=y_{20}-(x_{20}\tan D_{40}). \quad (13)$$

Thus for ray 40'':

$$y=x\tan D_{40}+b_{40} \quad (14)$$

and for ray 38'':

$$y=x\tan D_{38}+b_{38}. \quad (15)$$

Equations (14) and (15) may be solved simultaneously to produce the x and y coordinates of a point 46 where rays 38'' and 40'' intersect one another, said coordinates being designated $x_{46}$, $y_{46}$ respectively. Point 46 is the location of the apparent light source for the infinitely thin "slice" of the apparatus shown in FIG. 6; rotation about the x-axis will produce the locus of all apparent light source points, which will take the form of an annular ring similar to the annular ring 14 shown in FIG. 3. If a series of actual point sources of light were to be located in the locus described by rotation of point 46 about the x-axis, the reflected light would be distributed as desired.

In determining the type of tubular lens member required to produce an apparent light source at point 46, and in deriving expressions for its parameters, reference will be made to FIGS. 3, 5, and 7.

FIG. 3 shows a substantially cylindrical opening arrow 10; the wall of this opening is a surface denoted 48. This surface is located at $y_{48}$ in FIG. 7 and extends parallelly to the x-axis as shown in FIG. 7.

Referring to FIG. 5, the original, unmodified ray 30, emitted from actual light source 17 an impinging upon the reflecting surface 16 at point 20, makes an angle $E_{30}$ with the x-axis such that $$\tan E_{30}=y_{20}/(x_{20}-x_{17}) \quad (16)$$

Figure 7:
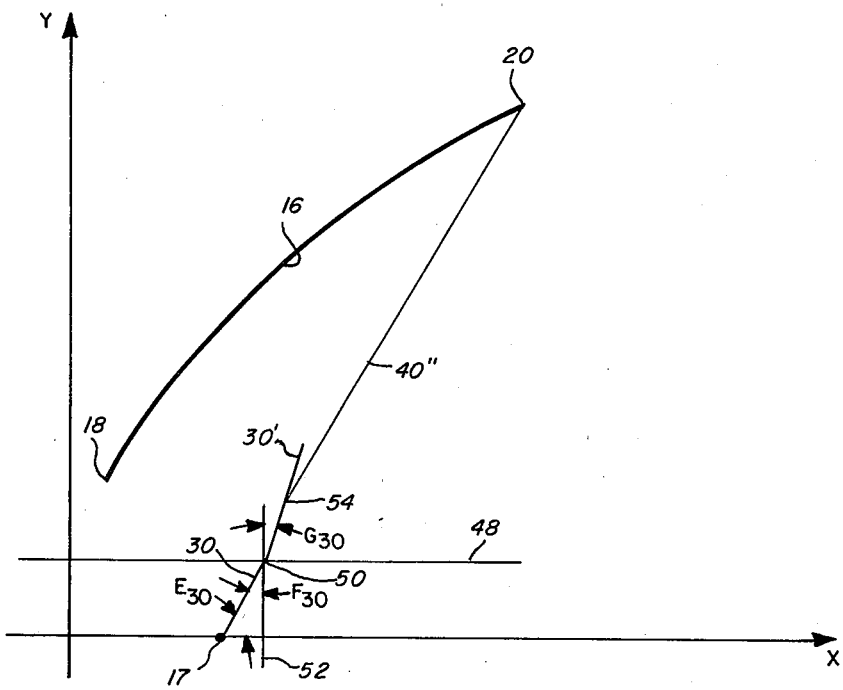

FIG. 7 shows that ray 30 intersects surface 48 at a point 50. The coordinates of this point 50 are such that $$y_{50}=y_{48} \quad (17)$$

$$x_{50}=y_{48}/\tan E_{30} \quad (18)$$

A line 52 may then be drawn normal to surface 48, passing through point 50. Ray 30 makes an angle $F_{30}$ with line 52 such that $$F_{30}=90°-E_{30} \quad (19)$$

At this point ray 30 undergoes refraction by Snell's Law:

$$n_1 \sin \theta_1=n_2 \sin \theta_2 \quad (20)$$

where $n_1$ is the refractive index of the first medium (air; $n_1=1$), $\theta_1=F_{30}$, and $n_2$ is the refractive index of the lens medium. Angle $\theta_2$, renamed $G_{30}$, is the angle which refracted ray 30' makes with normal line 52. Thus:

$$\sin G_{30}=\sin F_{30}/n_2 \quad (21)$$

A line equation may be solved for the y-intercept of ray 30' ($b_{30'}$):

$$b_{30'}=y_{52}-x_{52} \tan G_{30} \quad (22)$$

so, in general, for ray 30':

$$y=x \tan G_{30}+b_{30'}. \quad (23)$$

Projecting ray 30' until it intersects ray 40'' (derived in FIG. 6) will produce a point of intersection 54 (FIG. 7). Equations (23) and (14) may be solved simultaneously to produce coordinates $x_{54}$, $y_{54}$ which are coordinates on an outer surface 56 of a tubular lens member similar to numeral 8 of FIG. 3. In fact, the coordinate $x_{54}$ represents the total required extension of the desired tubular lens member in the x-direction.

Light ray 30' will undergo refraction by Snell's Law (shown in general form as equation (20)) such that:

$$n_2 \sin H_{30}=n_3 \sin H_{40} \text{ (FIG. 8)} \quad (24)$$

wherein $n_2$ is the refractive index of the lens medium, $n_3$ is the refractive index of air ($n_3=1$), $H_{30}$ is the angle which ray 30' will make with respect to a line normal to outer surface 56 of the desired tubular lens member and passing through point 54, while $H_{40}$ is the angle which ray 40'' will make with this same normal line. The normal line is thus far unknown, and must be derived. A hypothetical normal line is shown as numeral 58 in FIG. 8.

Normal line 58 makes an angle $I_{30}$ with respect to the x-axis such that $$I_{30}=J_{30}+H_{30} \quad (25)$$

where $$J_{30}=90°-G_{30} \text{ (ref. FIG. 7).} \quad (26)$$

Normal line 58 also makes an angle $I_{40}$ with a line parallel to the x-axis, such that $$I_{40}=D_{40}+H_{40}. \quad (27)$$

Since alternate interior angles must be equal, $$I_{40}=I_{30}; \quad (28)$$

thus $$J_{30}+H_{30}=D_{40}+H_{40} \quad (29)$$

and, by Snell's Law, $$\sin H_{40}=n_2 \sin H_{30}. \quad (30)$$

The unknowns are $H_{30}$ and $H_{40}$. Equations (29) and (30) may be solved simultaneously to produce values for $H_{30}$ and $H_{40}$; these values may then be substituted into either equation (25) or (27) to produce a value for $I_{30}$.

The standard line equation (11) is solved to produce a value for the y-intercept $$b_{58}=y_{34}-x_{54} \tan I_{30}. \quad (31)$$

Thus, in general, for normal line 58, $$y=x \tan I_{30}+b_{58}. \quad (32)$$

A similar set of calculations is employed to derive a line equation for a line 60 which is normal to surface 56 at that point 62 through which ray 38'' must pass. This line equation will have the form $$y=x \tan I_{26}+b_{60}. \quad (33)$$

Figure 9:
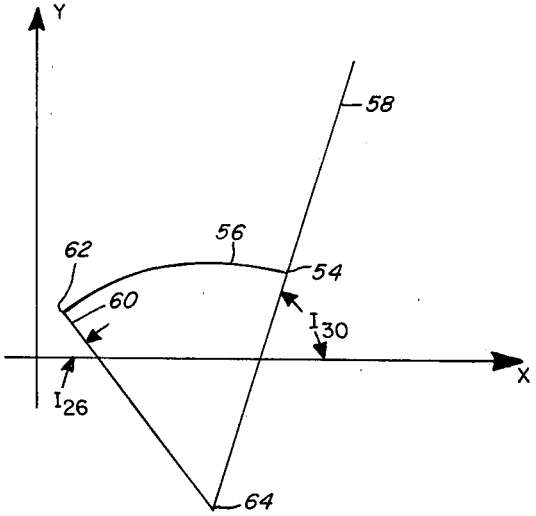
Figure 10:
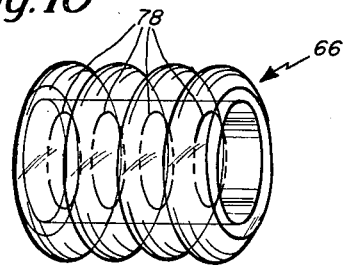
FIGS. 10–15 are perspective views of other forms of tubular lens members, also showing respective loci of apparent light sources.
Figure 11:
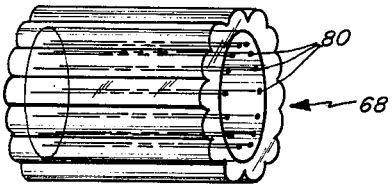
Figure 12:
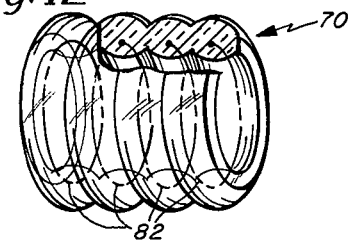
Figure 13:
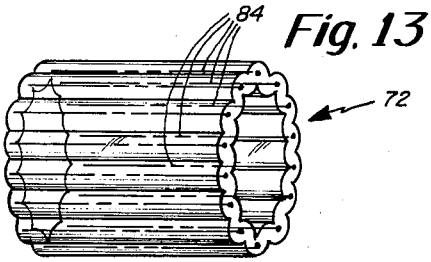
Figure 14:
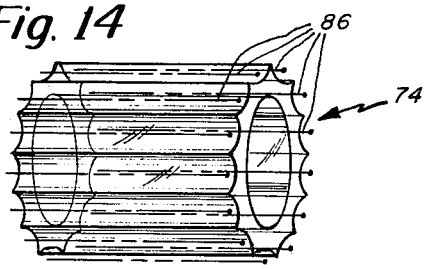
Figure 15:
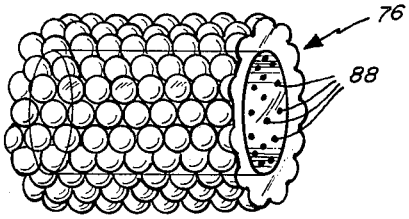

FIG. 9 illustrates normal lines 58 and 60.

Equations (32) and (33) may then be solved simultaneously to yield coordinate points $x_{64}$ and $y_{64}$ of the point of intersection 64 of lines 58 and 60. Surface 56 may be described, therefore, as the surface of rotation about the x-axis of an arc of a circle passing through points 54 and 62, having its center at point 64. Thus the first two objectives of the invention have been realized for this case; a method has been derived and means designed for producing a desired flood distribution of light utilizing the principles of refraction.

Should solution by the particular steps outlined above prove impossible, that is, no circle exists having its center at a point as 64 and passing through points as 54, 62 some other form of tubular lens member will be required. Examples of some such other forms are illustrated in FIGS. 10–15 inclusive, and denoted by arrows 66, 68, 70, 72, 74, 76 respectively. Various other forms of tubular lens member may be employed provided that they include refracting lens portions having surfaces which, in at least one cross-sectional view, may be represented by an arc of a circle having a center which is located in spaced relation to the central axis of the tubular lens member. Similar mathematical deductions are employed to derive the actual surfaces.

The lens member arrow 66 (FIG. 10) will create apparent light sources, the locus of which will be a set of annular rings as numeral 78; the locus of apparent light sources for the lens member arrow 68 (FIG. 11) will be a set of lines as 80; the locus of apparent light sources for the lens member arrow 70 (FIG. 12) will be another set of annular rings as 82; that of apparent light sources for the lens bodies arrows 72 and 74 (FIGS. 13 and 14) will be other sets of lines as 84, 86; that of apparent light sources for the lens body arrow 76 (FIG. 15) will be a cylindrical array of discrete points as 88.

It is pointed out that there are many variables which affect the solution by the method of the invention, to wit:

(1) focal length "a" of the paraboloidal reflecting surface
(2) depth (in an "x" direction) of the reflecting surface
(3) refractive index of the lens medium
(4) diameter of the central hole in the reflecting surface
(5) diameter of the cylindrical opening in the tubular lens member
(6) desired spread of the reflected beam.

Figure 16:
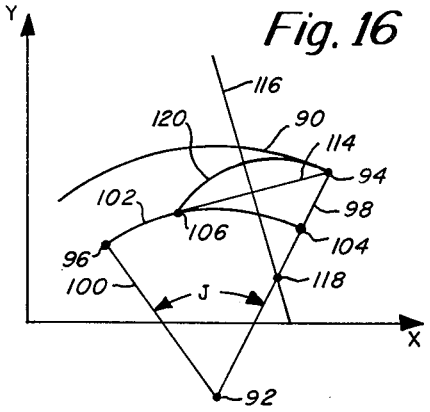
FIG. 16 is a diagrammatic view illustrating further the method of constructing a tubular lens member of the invention.

Since so many variables are involved, a simple solution such as that outlined with respect to FIGS. 5–9 inclusive will rarely be encountered. More often, a more complex form of tubular lens member will be required. For example, should a circle be described, as in FIG. 9, having its center at point 64 and passing through point 54, this circle may well not pass through a point as 62. FIG. 16 illustrates such a case; an arc 90 of a circle having its center located at a point 92 passes through one desired point 94 but does not pass through another desired point 96, and thus it is not possible to obtain physical means to produce the desired locus of apparent light sources via a simple lens member similar to that shown in FIG. 3. It will be necessary, therefore, to replace the single annular ring locus of apparent light sources as derived in FIGS. 5–9 with some other configuration which will have the same spreading effect on the reflected light rays. One simple approach is to create a double annular ring locus, with these rings spaced apart from one another in both x and y directions.

Once the first ring locus has been determined as previously described, it may be a relatively simple matter to modify this locus such that it becomes a double annular ring locus. In fact, it may not be necessary to derive the location of the second ring of the locus; one may be able to proceed directly to a modification of the tubular lens member using conventional plane geometry and/or trigonometric techniques. A plane geometry solution is disclosed below for purposes of clarity and simplicity.

Referring to FIG. 16, a line 98, extending between points 92 and 94, is described, as is a line 100, extending between points 92 and 96. The angle formed by the intersection of these lines is defined as angle J. An arc 102 of a circle, having its center at point 92 and passing through point 96, is described, said arc 102 being subtended by angle J and intersecting line 98 at a point 104. An arbitrary point 106, lying on arc 102, is selected as a point of intersection between the curves of two refracting lens portions.

The surface 108 of refracting lens portion 110 of a modified tubular lens body arrow 112 (FIG. 17) can therefore be described as the surface of rotation about the x-axis of that portion of arc 102 which extends from point 96 to point 106.

A line 114, extending between points 94 and 106, is then described as in FIG. 16. Line 114 is then bisected by a line 116, which line intersects line 98 at a point 118. An arc 120 of a circle having its center point at 118, extending between points 106 and 94, is used to generate a second surface of rotation 122 of refracting lens portion 124 of tubular lens member arrow 112 (FIG. 17).

Figure 17:
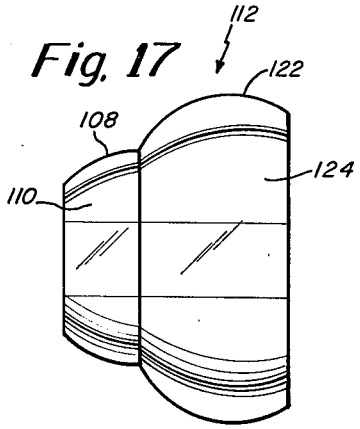
FIG. 17 is a side elevational view of a tubular lens member as derived in FIG. 16.

The substitution of a tubular lens member similar to that denoted by arrow 112 of FIG. 17 for the originally-derived tubular lens member will not appreciably alter the amount of divergence of the projected light beam. It will, however, alter the distribution of light intensity within the beam. Selection of a precise location for a point as 106 of FIG. 16, therefore, may be dependent upon the desired distribution of light within the beam.

Figure 18:
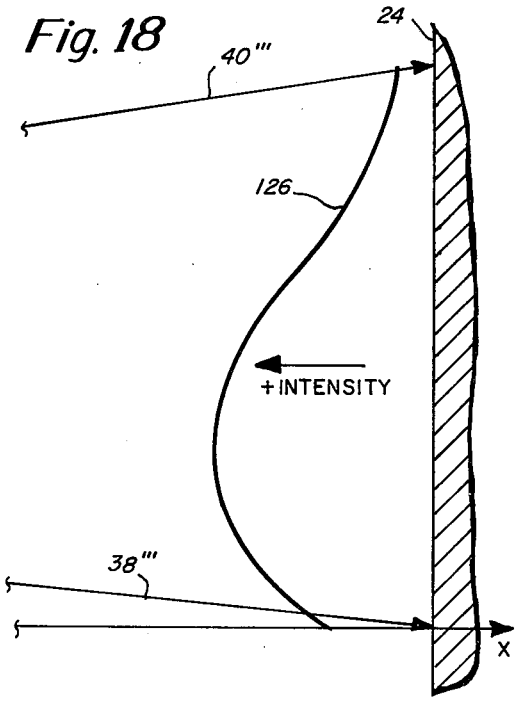
FIGS. 18 and 19 are diagrammatic views illustrating approximate light intensity gradient curves.

FIG. 18 illustrates the target surface 24 of FIG. 6, including a diverging light beam delineated by rays 40''' and 38''', produced by a luminaire system including a simple tubular lens member similar to that shown in FIG. 3, the surface of which may be considered as a surface of rotation about the x-axis of the arc 56 of FIG. 9. An approximate "intensity gradient" curve 126 has been superimposed on the Figure.

Figure 8:
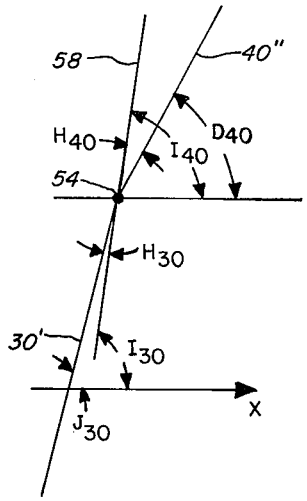
Figure 19:
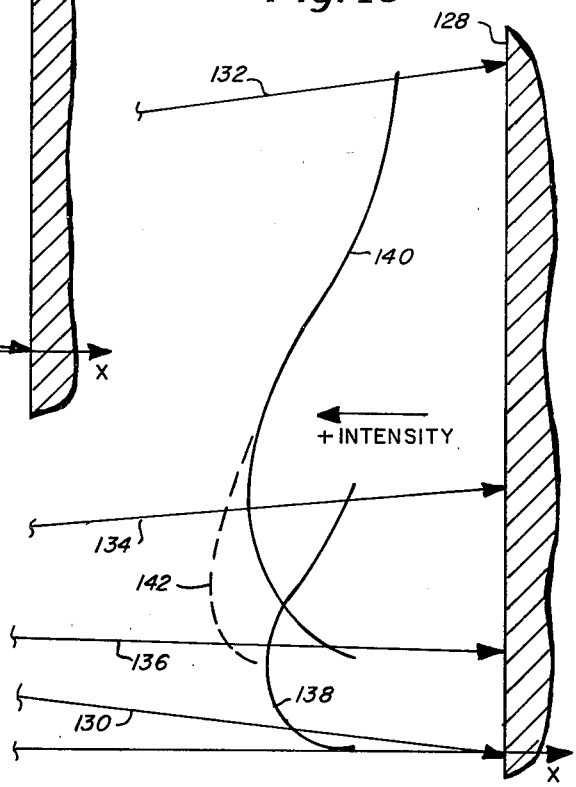

FIG. 19 illustrates a target surface 128, upon which is impinging a light beam, the extremities of which are defined by light rays 130 and 132 (corresponding to rays 38''' and 40''' of FIG. 8 respectively). This light beam has been produced by a luminaire system of the invention including a tubular lens member similar to that denoted by arrow 112 of FIG. 17.

Each of the refracting lens portions as 108 and 122 of this tubular lens member will produce a light beam, the two beams overlapping one another as they impinge upon the target surface 128. Extremities of the beam produced by refracting lens portion 108 may be defined by light rays 130 and 134, while the extremities of the beam produced by refracting lens portion 122 may be defined by rays 132 and 136. Superimposed on FIG. 18 are approximate "intensity gradient" curves; curve 138 is produced by refracting lens portion 108, and curve 140 is produced by refracting lens portion 122. Increased intensity, as shown by dashed curved line 142, occurs where the two light beams overlap one another. Precise intensity gradient curves may be obtained by spherical analysis of the luminaire system using conventional techniques.

It is pointed out that proper use of spherical analysis techniques, coupled with the method of producing apparent light sources as disclosed in this invention will allow tailoring of the intensity gradient curves as well as of beam divergence and breadth to produce a wide range of illumination characteristics. As a general rule, the intensity gradient curve will be made more uniform by the provision of additional apparent light sources through the inclusion of more refracting lens portions.

The derivation of the apparent light sources and thus of the tubular lens member may be modified in various ways. For example, the apparent light sources may be located such that they are outside the tubular lens member; this will require the actual light rays to cross over one another prior to their impingement upon the reflecting surface. Convex, concave or a combination of convex and concave surfaces may be employed for the refracting lens portions, on both inner and outer surfaces of the tubular lens member.

It may be desired to provide a luminaire apparatus constructed such that adjustment between a "spot" distribution and a "flood" distribution of projected light may be carried out by an operator. FIGS. 20–24 inclusive illustrate such a luminaire apparatus.

Figure 20:
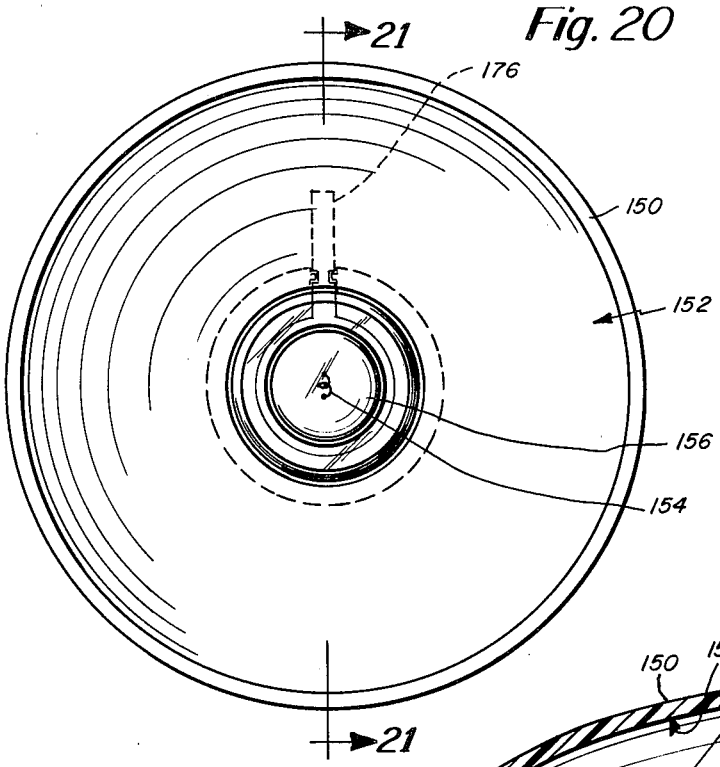
FIG. 20 is a front elevational view of an adjustable luminaire apparatus of the invention.
Figure 21:
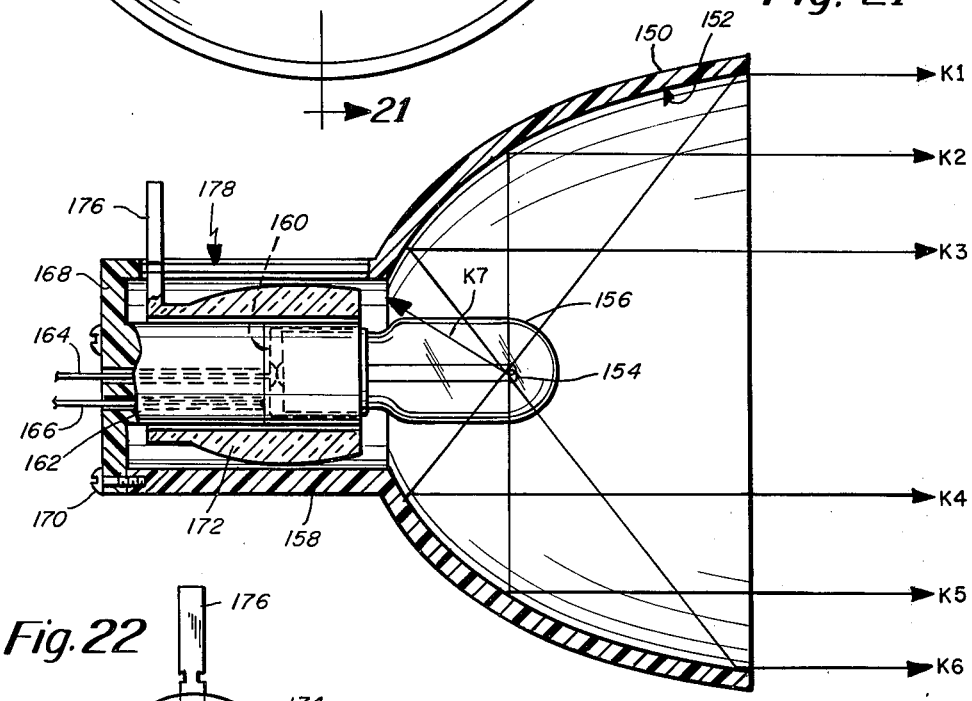
FIG. 21 is a cross-section taken on the line 21—21 of FIG. 20, illustrating the tubular lens member in a non-operative position, and further showing ray tracings of emitted light.

As shown in FIGS. 20 and 21, numeral 150 denotes a housing body having a paraboloidal reflecting surface arrow 152. At the focal point of reflecting surface 152 is located an actual light source, denoted by numeral 154, which may be, for example, the filament of a conventional incandescent bulb 156. Light rays emitted by source 154 impinge upon reflecting surface 152 and are reflected outwardly along parallel paths of travel, as indicated by arrows K1–K6 inclusive (FIG. 21), to provide a spot configuration of light in the well-known manner.

In locating the light source 154 at the focal point of the reflecting surface 152, various types of mounting may be employed. One suitable type of mounting is shown in FIGS. 20–21 wherein a substantially cylindrical extension 158 of housing body 150 has received therein a socket 160 in which is engaged bulb 156. In the arrangement shown the socket 160 may, for example, be supported on a base part 162 through which are located electrical conductors 164 and 166. Base part 162 is formed with an outer cap portion 168 for closing the end of the cylindrical extension 158, which may be detachably secured in place by means of screws as 170.

Figure 22:
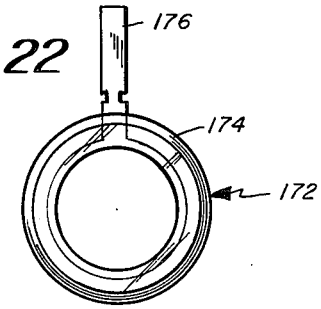
FIGS. 22 and 23 are views illustrating the tubular lens member of FIGS. 20 and 21 removed from the luminaire.
Figure 23:
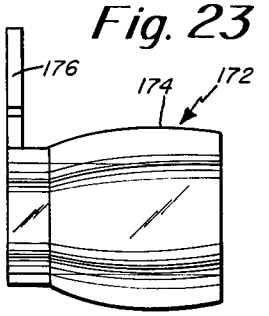

Slideably mounted in the cylindrical extension 158 is a tubular lens member arrow 172, more clearly illustrated in FIGS. 22 and 23, having a refracting lens portion 174 corresponding to arrow 8 of FIG. 3 and designed to provide a locus of apparent light sources in accordance with the method of the invention. Tubular lens member 172 extends around socket 160 and base part 162 in spaced relation thereto as is most clearly shown in FIG. 21. It will be observed that the inner diameter of tubular lens member 172 is slightly larger than the outer diameter of base part 162, socket 160 and bulb 156 such that tubular lens member 172 may be slid forward so as to substantially surround bulb 156 as is shown in FIG. 24.

Sliding movement of tubular lens member 172 may be carried out in various ways; one suitable means for sliding movement is illustrated and is intended to be representative of other means. FIGS. 22 and 23 illustrate tubular lens member 172 removed from the luminaire, and present a construction having a notched slide part 176 for manual operation. Notched slide part 176 is engaged in a keyed slideway arrow 178 of the cylindrical extension 158 of housing body 150 (FIG. 21).

Figure 24:
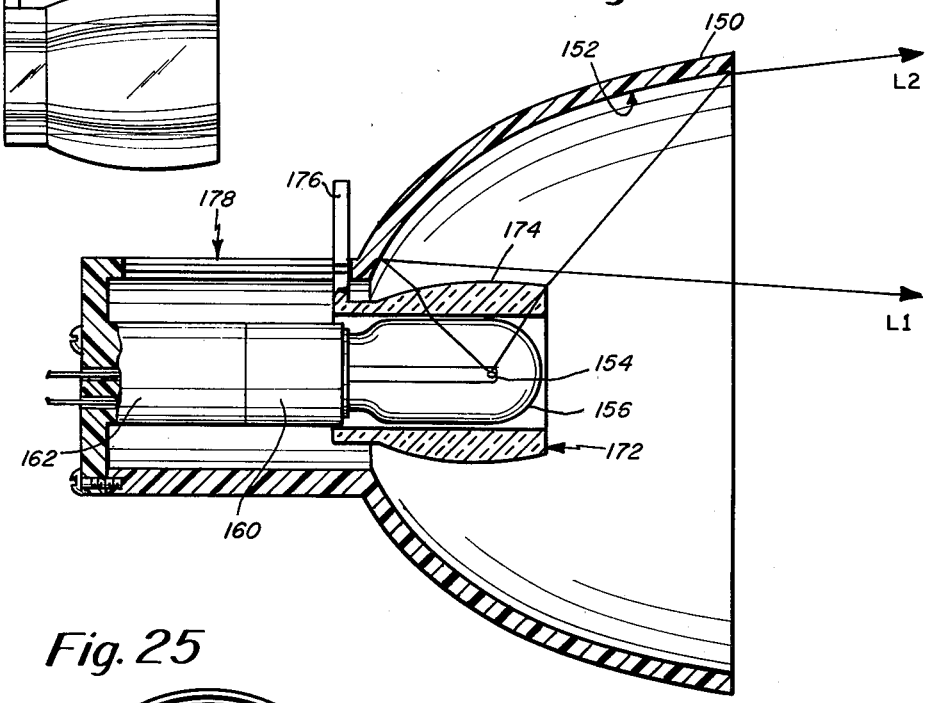
FIG. 24 is a diagrammatic view of the apparatus of FIGS. 20–23, illustrating the tubular lens member in an operative position, and further showing ray tracings of emitted light.

When a flood configuration of projected light is desired, manual operation of slide part 176 serves to move tubular lens member arrow 172 forward into an operative position such that it substantially surrounds bulb 156, as is illustrated in FIG. 24. Light rays L1 and L2 correspond to rays 38''' and 40''', respectively, of FIG. 6. An annular ring locus of apparent light sources is thereby created, and the desired flood distribution produced. It will be noted that a partial flooding effect may be produced by placing tubular lens member 172 in a partially operative position, by not sliding it fully forward. In this manner a continuous adjustment between spot and flood extremes may be produced.

Figure 25:
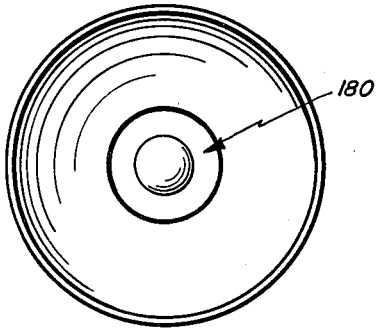
FIG. 25 is a front elevational view of an adjustable luminaire apparatus with tubular lens member removed.

Tubular lens member arrow 172 may be further modified to minimize the loss of light caused by the presence of the large hole in reflecting surface 152 through which tubular lens member 172 is to be advanced. Examination of FIG. 21 shows a light ray K7 which is lost through this hold. FIG. 25 shows the luminaire apparatus with tubular lens member arrow 172 removed, and the hold, as shown most clearly in this Figure, is denoted by numeral 180.

Figure 26:
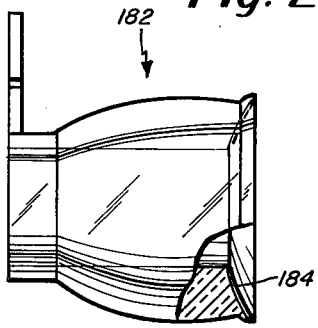
FIG. 26 is a side elevational view, partially broken away, of an adjustable tubular lens member having complementary reflector means.
Figure 27:
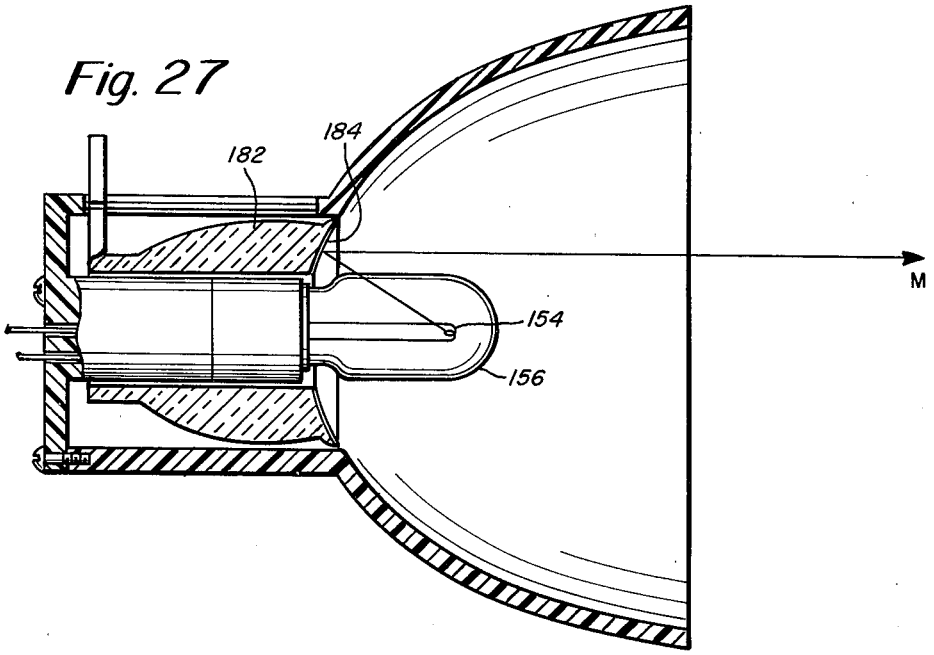
FIG. 27 is a diagrammatic view of an adjustable luminaire including a tubular lens member having complementary reflector means and further showing ray tracings of emitted light.

FIG. 26 shows a tubular lens member 182 in a modified form wherein a reflecting portion as 184, complementary to the paraboloidal reflecting surface of the luminaire body, has been provided at an outer end thereof. The effect of this reflecting portion 184 is shown diagrammatically in FIG. 27, in which light ray M (corresponding to light ray K7 in FIG. 21) impinges upon reflecting portion 184 and is reflected outward in a path of travel parallel to the central axis of the luminaire body.

I claim:

1. A method of producing a predetermined flood distribution of light from a luminaire body, said luminaire body including a paraboloidal reflecting surface and an actual light source located at the focal point of the reflecting surface, in which the actual light source is converted by clear refraction into a multiplicity of apparent light sources lying in a predetermined locus of such apparent light sources, the light radiating from the said apparent light sources impinging upon the reflecting surface at angles of incidence such that reflection from the reflecting surface provides a diverging light beam of predetermined character.

2. A method of producing a predetermined flood distribution of light from a luminaire body, said luminaire body including a paraboloidal reflecting surface and an actual light source located at the focal point of the reflecting surface, said method characterized in that radiation from the light source undergoes clear refraction to produce a multiplicity of apparent light sources lying in a predetermined locus of such apparent light sources, the light radiating from the said apparent light sources impinging upon the reflecting surface of the luminaire body at angles of incidence such that reflection from the reflecting surface profides a diverging light beam of predetermined configuration.

3. The invention of claim 2 in which the refracted light produces a multiplicity of apparent light sources lying in a predetermined locus of such apparent light sources, the said locus comprising at least one line parallel to the central axis of the reflecting surface.

4. The invention of claim 2 in which the refracted light produces a multiplicity of apparent light sources lying in a locus of such apparent light sources, the said locus comprising at least one annular ring concentric with the central axis of the reflecting surface.

5. The invention of claim 2 in which the refracted light produces a multiplicity of apparent light sources lying in a locus of such apparent light sources, the said locus comprising a substantially cylindrical array of discrete points.

6. The invention of claim 1 in which the clear refraction of light into a multiplicity of apparent light sources is carried out by a transparent refracting lens means free from diffusing agencies whose refractive characteristic is mathematically derived to produce a required flood configuration.

7. In a method of controlling reflection of light in which an actual source of light is located at the focal point of a reflector means, the steps which include actuating the light source to produce a light output having a spot configuration, then interposing between the actual light source and the reflector means optically designed transparent tubular lens means free from diffusing agencies which present curved refracting parts of a mathematically derived configuration and which, by clear refraction, varies the angle of incidence at which light impinges on the reflector means and thus changes the light output from a spot configuration to a predetermined flood configuration characteristic of the mathematically derived curved refracting parts.

8. The method of claim 7 in which the interposing of the lens means is carried out along a path of travel which is parallel to the central axis of the reflector means.

9. In a method of controlling reflection of light in which an actual source of light is located at the focal point of a reflector body, the steps which include actuating the actual light source to produce a light output having a spot configuration and then interposing, between the actuated light source and the reflector body optically designed transparent lens means free from diffusing agencies which present refracting parts having respective focal points which lie in a locus of such points and which, by clear refraction, vary the angle of incidence at which light impinges on the reflector body and thus changes the light output from a spot configuration to a flood configuration, said interposing of the lens means being carried out parallel to the central axis of the reflector body, the said lens means being operative to provide refracted rays of light which form apparent light sources occurring externally of the said actual light source, and the locus of said apparent light sources having a configuration similar to the locus of the focal points of the lens means.

10. The method of claim 1 in which the apparent light sources occur externally of the focal point of the reflector body and have a linear configuration.

11. The method of claim 1 in which the apparent light sources occur externally of the focal point of the reflector body and have a circular configuration.

12. The invention of claim 1 in which the apparent light sources occur as separate and distinct points having a predetermined relationship to one another.

13. Luminaire apparatus including a housing body having reflector means located therein, a light source located in the housing body at the focal point of the reflector means, light refracting means mounted between the light source and the said reflector means, the light refracting means comprising a tubular lens member, said tubular lens member being formed with clear light refracting lens portions which produce a multiplicity of apparent light sources lying in a predetermined locus of such apparent light sources.

14. The invention of claim 13 in which the reflector means is of a paraboloidal shape.

15. The invention of claim 13 in which the light refracting lens means includes at least one annuloid convex lens element extending around the tubular body on an external surface thereof.

16. The invention of claim 13 in which the locus of apparent light sources is mathematically derived to provide a predetermined character to a resultant reflected light beam.

17. The invention of claim 13 in which the reflector means is formed with an aperture through which the said path of travel of the tubular lens means extends and the tubular lens means includes auxiliary reflector means movable into the aperture.

18. The invention of claim 13 in which the reflector means if of paraboloidal shape and is formed with an aperture through which the said path of travel of the tubular lens means extends, and said tubular lens means being constructed with auxiliary reflector means having a paraboloidal shape which is complementary with respect to the paraboloidal shape of the reflector means.

19. The invention of claim 13 in which the reflector means is of paraboloidal shape and is formed with an aperture through which the said path of travel of the tubular lens means extends, and said tubular lens means being constructed with auxiliary reflector means having a paraboloidal shape which is complementary with respect to the paraboloidal shape of the reflector means and said auxiliary reflector means including two reflector parts occurring at opposite ends of the tubular lens means.

* * * * *